US009123311B2

(12) United States Patent
Russell

(10) Patent No.: US 9,123,311 B2
(45) Date of Patent: Sep. 1, 2015

(54) ADAPTABLE LIGATURE FOR THE MOUTHPIECES OF WIND INSTRUMENTS

(71) Applicant: Roberto Manuel Russell, Entre Rios (AR)

(72) Inventor: Roberto Manuel Russell, Entre Rios (AR)

( * ) Notice: Subject to any disclaimer, the term of this patent is extended or adjusted under 35 U.S.C. 154(b) by 73 days.

(21) Appl. No.: 13/863,421

(22) Filed: Apr. 16, 2013

(65) Prior Publication Data

US 2014/0305279 A1 Oct. 16, 2014

(51) Int. Cl.
*G10D 9/02* (2006.01)

(52) U.S. Cl.
CPC ..... *G10D 9/02* (2013.01)

(58) Field of Classification Search
USPC ..... 84/383 R
See application file for complete search history.

(56) References Cited

U.S. PATENT DOCUMENTS

| | | | | |
|---|---|---|---|---|
| 4,074,899 | A * | 2/1978 | Hochstetler | 269/249 |
| 6,670,534 | B2 * | 12/2003 | Vildosola Erdociain | 84/383 R |
| 7,763,787 | B2 * | 7/2010 | Jean | 84/380 R |
| 8,217,248 | B1 * | 7/2012 | Feliciano | 84/383 R |
| 2004/0011183 | A1 * | 1/2004 | Fliegel et al. | 84/383 R |

* cited by examiner

*Primary Examiner* — Christopher Uhlir
(74) *Attorney, Agent, or Firm* — Frommer Lawrence & Haug LLP; William S. Frommer

(57) ABSTRACT

The present invention relates to a ligature for single-reed wind instruments that comprises a main multidirectional pivot system allowing the reed to vibrate freely while providing all possibilities of clamping force both to minimal contact and to extreme fit, and which adapts to table angle thereby optimizing the relationship between fitting and sound quality.

10 Claims, 12 Drawing Sheets

ADAPTABLE LIGATURE FOR THE MOUTHPIECES OF WIND INSTRUMENTS

FIELD OF THE INVENTION

The present invention relates to a ligature for musical wind instruments, and in particular, to a ligature for single-reed wind instruments.

DESCRIPTION OF THE RELATED ART

Single-reed wind instruments, such as the saxophone or clarinet, are musical instruments whose sound generator consists of three elements; a single reed (or cane), a mouthpiece and a ligature.

A reed is a thin strip of material which vibrates producing a sound. The energy source of wind instruments is the "blow" of air that leaves the player's mouth, and the sound source of woodwind instruments such as saxophones and clarinets is the so called "cane" or "reed". The player's breath causes the cane to vibrate producing the sound.

The frequencies, also called harmonics, are reflected with the vibration of the reed and punctually correspond to each one of the thicknesses of the cane. According to the pressure or support point of the player's lip over the cane, said harmonics can be highlighted or overshadowed, expanding the tonal possibilities of a sound (i.e., of a musical note), depending on the choice of the player, his/her musical characteristics, technical finesse; physiognomy, etc. Therefore, the larger the surface of the freely vibrating reed, the better such frequencies are reflected, and thus the tonal possibilities are expanded.

Mouthpieces are basically conical or cylindrical tubes depending on the brand or model, with a wedge in the form of a cylindrical tube in order to attach it to the instrument. This wedge may be internal or external according to the type of instrument (clarinet or saxophone).

Mouthpieces have two main functions. One is to provide support to the performer's mouth, and to this end, they have an anatomical design so that the performer can place it in his/her mouth and force air through it. The second function is to reflect and amplify the sound produced by the cane, acting as a soundboard or baffle, in the chamber.

The ligature serves to clamp the reed on the mouthpiece of the instrument, and constitutes an element of fundamental importance in the resulting sound that is produced.

The attached FIG. 1*a* shows a typical prior art ligature, in perspective and FIG. 1*b* shows said ligature placed on the mouthpiece. Basically, it is a ligature band that surrounds the mouthpiece and the reed, exerting pressure on them, and that typically has a fitting system.

The intended purpose of ligatures is to provide a proper fitting while allowing the reed to vibrate freely. Additionally, they must be capable of being properly placed, and the fitting and clamping means should not damage the reed. Other advantageous features of the ligatures are to be practical in the replacement of canes and of easy and quick fitting.

BACKGROUND

In the prior art there is a wide range of ligatures, which are most commonly made out of metal, such as brass, but can also be made out of leather, wire mesh, rubber and plastic, among other materials. They have different fitting systems, adjustable and fixed, with different contact surfaces where the reed is supported, to highlight or overshadow some sound frequencies.

The qualities of some prior art ligatures are chosen for particular uses depending on the type of music or type of mouthpiece. Some ligatures are specific to the brand and model of the mouthpiece; they are purchased as a set (mouthpiece-ligature) and can only be used exclusively for that mouthpiece, either by the particular format or insert, or by its specific functional system.

Features Per Register:

The general features of each of the registers are due to the reed having the same dimensions both for low and high notes. Therefore, it is responsible for supporting different vibration stresses with respect to the note that is generated according to the functional length of the instrument tube and to the lip pressure required to keep it within the musical parameters.

Overall and considering the synesthesia, the best performance occurs in the middle register. The differences in volume and sound quality of the extreme registers constitute a point to solve.

Sound Tuning and Character:

Some sounds are more forced and unstable than others within the musical scale. These changes in sound behavior are a consequence of different stresses experienced by the cane, which in turn varies the tuning and the airflow.

While manufacturing the instrument, this defect is partially compensated by permanently adjusting the size of the chimneys. It should be noted that the stability of an instrument with respect to these features varies according to manufacturing quality.

Nonetheless, there are zones, and even notes in particular and in the entire register, which respond differently to the emission of constant sound and dynamic, some notes are unstable in tuning, some in volume, some in sound quality, and others vary their behavior completely in relation to different musical intervals.

The changes that are needed from the performance to compensate these inherent defects of the instrument affect the effort level of the instrumentalist, sacrificing musical expression.

The extent of the mobility margins to correct these defects to obtain more uniformity in sound and tuning in the entire register, constitute a point to solve.

Dynamics:

The ability to achieve both the minimum and maximum volume on the same note, always maintaining the sound quality and tuning in the entire register, is a goal sought by both performers and instrument manufacturers.

While this may be compensated by the skill of the performer, there have been physical approaches to enhance these skills, from creating instrument models to accessories that form the sound generator:

Aspects to Solve Regarding the Typical Defects of Prior Art Single-Reed Instruments The mouthpiece itself is a continuation of the general tube of the instrument and is adapted so that the performer can direct air through it generating a sound which will be projected into the tube of the instrument. The latter receives the sound, amplifies it and, depending on its shape, may modify it by highlighting or overshadowing some frequencies, but its function is conditioned by the source of the sound.

The sound originates in the cane, its characteristics depend on the frequency range of the cane, and the frequencies are proportionally related to the mass volume that acts as a vibrating body, i.e. the more the reed surface vibrates in all of its dimensions, more rich in harmonics is the sound. The reed, in turn, cannot vibrate without being attached to the mouthpiece as the resulting space on the mouthpiece tip after being coupled is what allows the passage of air, which acts as energy and produces the vibration of the reed from the thinnest area.

When the reed is attached to the mouthpiece by means of the ligature, it loses vibratory properties in the pressure area where it is held.

The clamping pressure affects the general sound, and this latter can vary depending on the area of the cane affected by such pressure; as it is known, the cane contains—before a vibration—different frequencies in all its dimensions. For example, if the pressure area belonged to the low frequencies this would be perceived with a more strident general sound.

The ligature serves to clamp the reed and, for this reason, the vibratory behavior of the reed depends on it and thus the general result of the sound, which in him is projected through the mouthpiece to the general instrument tube.

Sound quality is measured by the possibilities the performer may have to control a sound in the following aspects:

- Number of harmonics to compose a personal sound with respect to the choice of musical criteria (increased tonal possibility).
- Wider dynamic range (volume) without loss of tonal possibilities.
- Full control of tuning without sacrificing tone and dynamics.

Another aspect to consider is the table angle relative to the clamping of the cane. Since the reed must be clamped in the area prepared to perform the fitting, it requires a wide pressure strip to prevent side movements turning around a point over the table plane. Therefore, the ligature band or the contact surface should have two or more pressure points, or may be of uniform contact over a wide area.

The more surface is longitudinally embraced, firmer and more divided is the force in crosswise direction.

Given the mouthpiece general shape, the table angle has always been a problem at the time of firmly attaching the reed without overly affecting the containment and the vibration of the same as the reed requires to be evenly and uniformly clamped over the table without affecting its structure.

The conicity of the body and the support angle generated by the table tend to destabilize the fitting pressure, and then the ligature tends to yield toward the lowest volume end.

Therefore, the more contact the ligature has over a surface in general, the better the clamping force is.

The problem that arises with prior art ligatures is that the higher the clamping force is, fewer are the possibilities of vibration of the reed, affecting the ultimate goal: "sound quality".

Moreover, in ligatures wherein pressure is exerted on a given area of the cane in order to provide an established sound, the cane may be damaged due to pressure concentration.

Furthermore, the cane fitting control over the table angle cannot be achieved uniformly since more pressure will always be exerted toward one of the two ends of the cane.

In ligatures specifically manufactured for a mouthpiece using a mold, a way of fitting that guarantees pressure uniformity at all contact points with the cane does not exist, whether in any of the formats known as contact points with the reed.

In the case of prior art ligatures that match much better with the table angle and, consequently the pressure is uniform, it must be taken into account that table angles vary depending on the mouthpiece brand or model, which limits the ligature use, because the cane surface is never equal to another one. Furthermore, it should be noted that the performers often use various mouthpiece types, according to the need and occasion.

Ligatures manufactured with materials copying the general shape of the mouthpiece, such as the ones made of leather, rubber or textile materials, work very well regarding the reed response to a vibration, but they are limited in tonal possibilities and in dynamics, since the reed is contained by a material with elastic properties which makes the cane vibrate in a particular and very specific manner. Such prior art ligature types are used for specific sonorities.

The ligature location on different points along the table is also a tonal variation possibility, if the ligature is positioned closer to one end of the mouthpiece, as for example towards where the mouth is located, a more centered and with less volume possibility is obtained. By contrast, if the ligature is located towards the side where the mouthpiece is coupled to the instrument, the sound is broader, aggressive and has more dynamics possibilities. This is due to changes in length of the zone of the cane that is vibrating more freely, from the pressure point to the tip of the cane.

These location possibilities are generally limited for most prior art ligatures, as they work better in some points than in others, as the conicity of the mouthpiece conditions the quality of the clamping radial force. This is because the length of the utilized ligature hand varies according to the diameter of the contact area with the mouthpiece.

In summary, prior art ligatures condition the sound quality and a cane clamping element which can balance the relationship between clamping quality and the maximum sound quality has not been achieved.

In cases where the known ligatures provide a certain feature, the loss of some vibratory behavior of the reed is, on the other hand, suffered, either in volume or sound character.

To avoid pressure concentration, some ligatures comprise metal rounded plates to partially surround the cane in order to provide an even and uniformly distributed support, so as not to damage the reed (see FIG. 1*c*). However, it is known that a uniform distribution is detrimental to the sound quality since it limits the vibration of the reed, as it will be explained in detail later.

Ligatures which present minimum contact with the mouthpiece, known in the prior art, balance a bit more this relationship. As the ligature has fewer support points over the mouthpiece body and more over the cane, the reed vibrates more freely because it has a little more vibration mobility with respect to the table angle. In this case, the ligature body in its entirety is the one that suffers an elastic stress to allow this movement.

Some patent applications using pivoting means to improve the fitting and clamping quality are referenced below:

U.S. Pat. No. 5,623,111 discloses a ligature having a fitting system that uses a transversal screw which enables a more practical and effective general clamping exerting a more equitable pressure from the band ends over the support plate. It offers the possibility to replace different support plates that affect different cane areas giving sonority options. However, these sonority options are applied to the cane in a forced manner. The support plates are wedged on the fitting screw center which is transversely located over the bottom area forming a support with pivoting wedge. The function of this pivot system is to rotate the screw during the ligature fitting process without affecting the plate position. Once this fitting process concludes, the pivot system is annulled.

PCT Patent Application No. WO 2006/016061 A1 discloses a ligature comprising a pivoting means enabling its body to adjust to that of the mouthpiece in its upper support, thereby allowing some mobility margin for a better adaptation to the mouthpiece body together with the cane. The mobility angle is limited by the ligature hand once it makes contact by means of the fitting. Accordingly, its mobility is annulled during the operation not being capable of vibrating separately from the mouthpiece. The area making contact with the cane belongs in a fixed manner to the ligature band and responds according to the adaptation margins that allow the contact points over the mouthpiece body. Moreover, the pivoting movement is also limited because it is divided into two supports located at the band's ends, whose axes are directed in different angles. The band curvature corresponds to the mouthpiece body curvature forming a circle from the frontal perspective, and the axes direction tends to be located towards the center of the circumference. Therefore, general pivoting movement of the two supports does not correspond to the same axis. In conclusion, the operation points to the relationship between the ligature and the mouthpiece and the result in terms of improvement on the reed fitting and clamping is a consequence.

U.S. Pat. No. 8,217,248 B1 discloses a ligature which allows a better adaptation of the reed over the mouthpiece table. Its operation points to the relationship between the ligature and the cane, and it is applied to both the ligature body and the support plate, thereby composing a device that works together. The ligature body acts as an elastic means on torsion mode, applied to a minimum contact point over the mouthpiece body upper area, which allows a better adaptation of the support plate position over the cane. This elastic means on torsion mode only acts when the ligature is fitted by the general screw located at the bottom area exerting pressure on the cane. The support plate is supported at the general fitting screw tip by means of a smaller screw that allows some movement of the plate, and is only trapped by the limit which the head diameter of such screw presents. This system allows support plates replacement or adjustment. Plate mobility parameters allow the fitting screw to rotate on its axis. They also allow the plate to partially fit its support angle relative to the table angle; this mobility is limited, by the lateral torque exerted by the screw and by the limit provided by its head. The pivoting mobility is partial and is limited by the position of the ligature body, and also depends on the mouthpiece model since when the table angle of a mouthpiece model is very pronounced, the pivoting capacity is lower. As it presents a minimum support point, and none over the mouthpiece sides, it does not allow manipulation to move the mouthpiece when correcting the general instrument tuning, causing that when taking the sound generator (mouthpiece-cane-ligature) with the hand, the ligature moves sideways or slips off.

As can be observed, none of these applications have succeeded in solving all the aspects mentioned above.

SUMMARY OF THE INVENTION

In a general aspect, the invention resides in a ligature for attaching the reed to the mouthpiece of a single-reed wind instrument, basically constituted by a body, a fitting and clamping means and a multidirectional pivoting means.

In a preferred embodiment, the ligature body comprises a ligature band and a base provided with a threaded vertical hole arranged to receive the fitting and clamping means. In this embodiment the fitting and clamping means is constituted by a fitting and clamping screw comprising a fitting knob on one end of the threaded body and a ball-shaped, ending on the other end. The latter is attached on one side to the screw threaded body through a small cylindrical portion or "neck", whose diameter is smaller than that one of the ball and of the threaded body and is, further, engageable to a "box" this constituting the multidirectional pivoting means. Preferably, the box comprises:

a very thin contact washer which is located over the ball's upper area in crown from in order to receive the fitting pressure exerted by the internal upper limit of the box;

a hollow screw of a greater diameter than that of the ball, hollowed from an end up to about the middle of its length forming an internal cavity in order to contain the ball and the contact washer in its interior; and a body, formed by a preferably cylindrical external surface and an internal surface comprising a threaded hole (female thread) in whose lower area presents a floor providing, thus, a glass-shaped cavity arranged to receive the hollow screw. This floor has a hole practiced at its center so that the neck can escape once the device is assembled and a groove at the base extending from such hole to a side wall of the box body, leading to another hole practiced from a side perspective over that wall, arranged to wedge and move the ball along with the neck up to the center of the box.

In this embodiment, the base is further provided, in its upper part, with a cavity of the same shape as the box surface having a protrusion (fold) in vertical direction. The threaded vertical hole extends from the bottom center to the vertical plane where the cavity begins. In this embodiment there is provided a sound modifier means, with contact points to the cane, comprising a sound modifier plate which is engageable to the box.

In another embodiment, the sound modifier Means is part of the box, forming a single element.

In a still more preferred embodiment, the ligature has a further pivoting means at the base of its body. Preferably, this pivoting means is constituted by an axis transversally applied to the table in the form of two screws embedded to both sides of the base piercing and clamping both ends of the ligature band.

In another embodiment, the fitting and clamping means may be arranged at the top of the ligature and, therefore, become independent from the multidirectional pivoting means.

General operating features and the advantages of the ligature of the present invention will now be described in greater detail in connection with the preferred embodiments, which should be considered as only exemplifying and not limitative of the present invention.

BRIEF DESCRIPTION OF THE DRAWINGS

The constructive features of the present invention and its advantages over what is currently known in the art will be more evident in the present specification, taken in conjunction with the accompanying drawings, in which.

DETAILED DESCRIPTION OF THE PREFERRED EMBODIMENTS

Figure 1B:
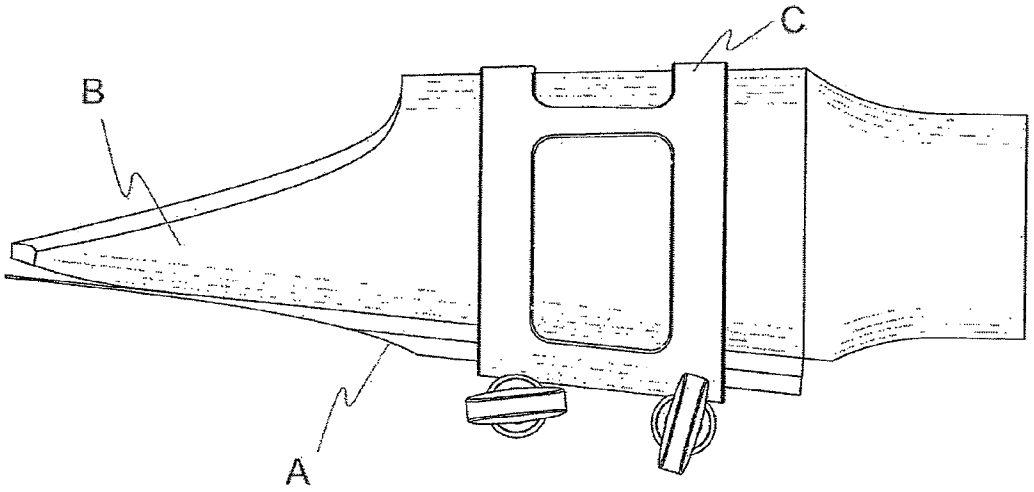
FIG. 1b Prior Art
FIG. 1*b* shows a side view of the ligature of FIG. 3*a* placed.
Figure 1C:
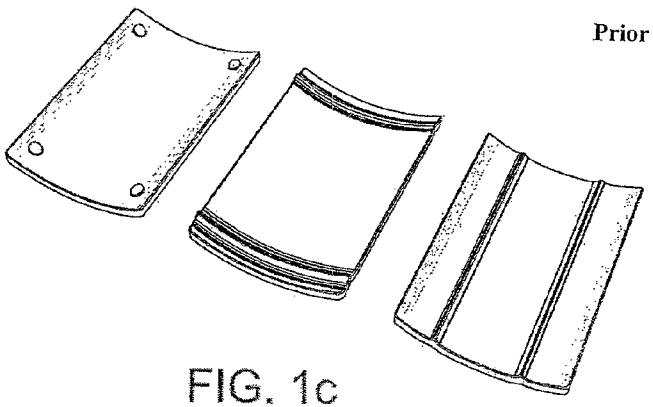
FIG. 1c Prior Art
FIG. 1*c* is shows different variants of prior art sound generating plates.
Figure 1A:
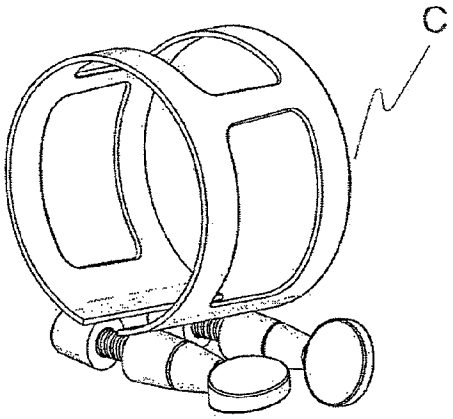
FIG. 1a Prior Art
FIG. 1*a* is a schematic perspective view of as typical prior art ligature (C).
Figure 2B:
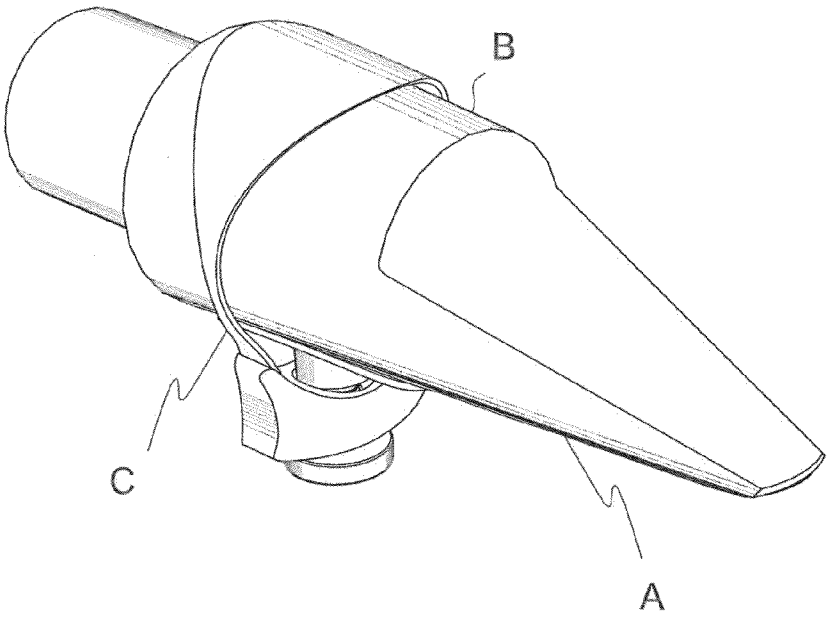
FIG. 2*b* shows a top perspective schematic view of the ligature of FIG. 2*a* placed on the mouthpiece and clamping the reed.
Figure 2A:
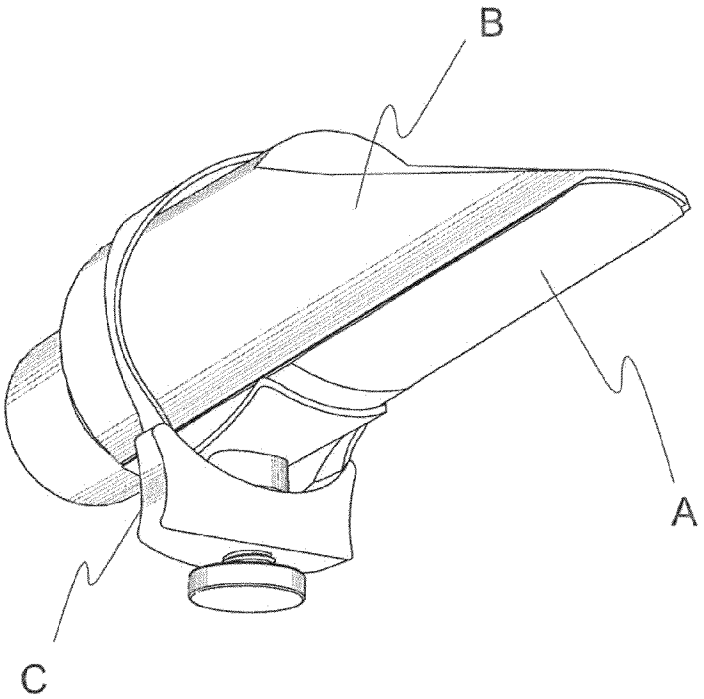
FIG. 2*a* shows a bottom perspective schematic view of a preferred embodiment of the ligature of the present invention placed on the mouthpiece and clamping the reed.
Figure 2D:
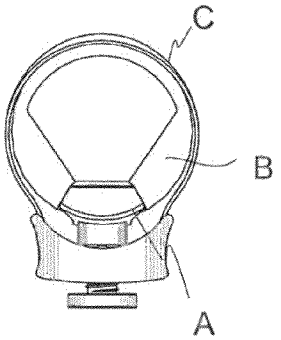
FIG. 2*d* shows a schematic sectional view of the ligature of FIG. 2*a* placed on the mouthpiece and clamping the reed.
Figure 2E:
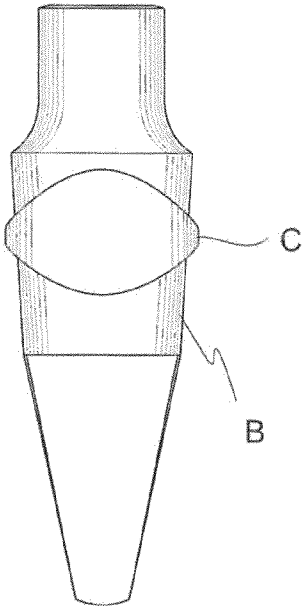
FIG. 2*e* shows a top schematic plan view of the ligature of FIG. 2*a* placed on the mouthpiece and clamping the reed.
Figure 2C:
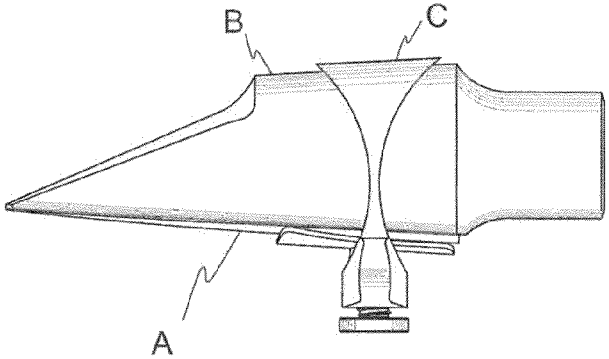
FIG. 2*c* shows a schematic side view of the ligature of FIG. 2*a* placed on the mouthpiece and clamping the reed.
Figure 3C:
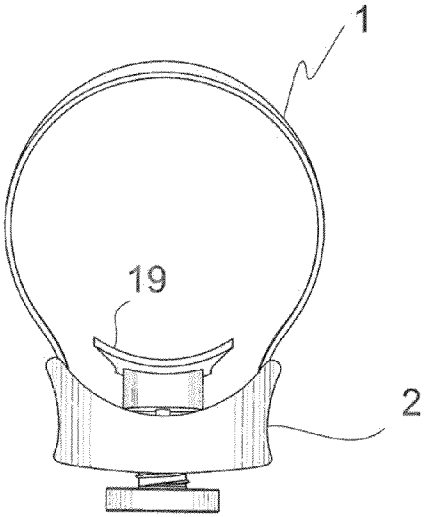
FIG. 3*c* shows a schematic sectional view of the ligature of FIG. 2*a*.
Figure 3D:
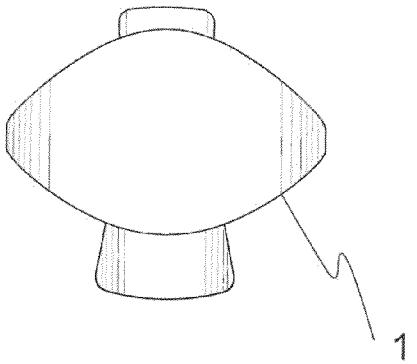
FIG. 3*d* is a top schematic plan view of the ligature of FIG. 2*a*.
Figure 3B:
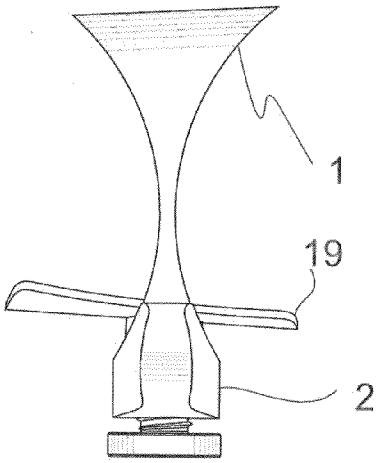
FIG. 3*b* is a schematic side view of the ligature of FIG. 2*a*.
Figure 3A:
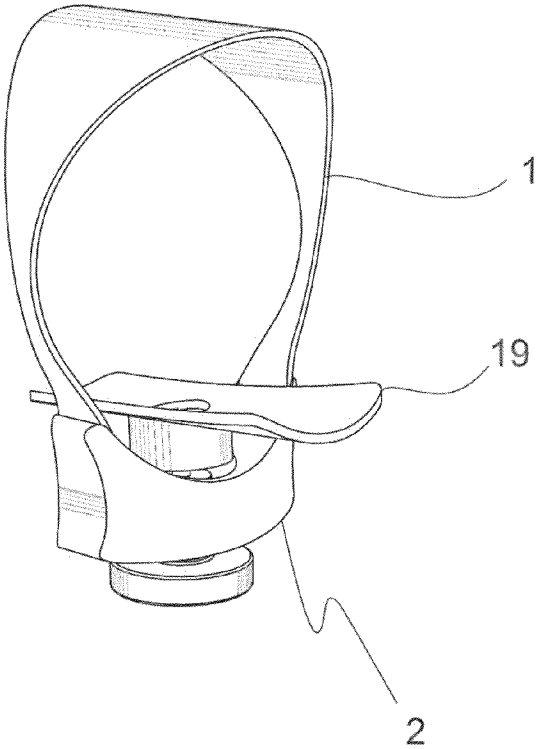
FIG. 3*a* is a schematic perspective view of the ligature of FIG. 2*a*.
Figures 3E, 4, 5A, 5B, 5C:
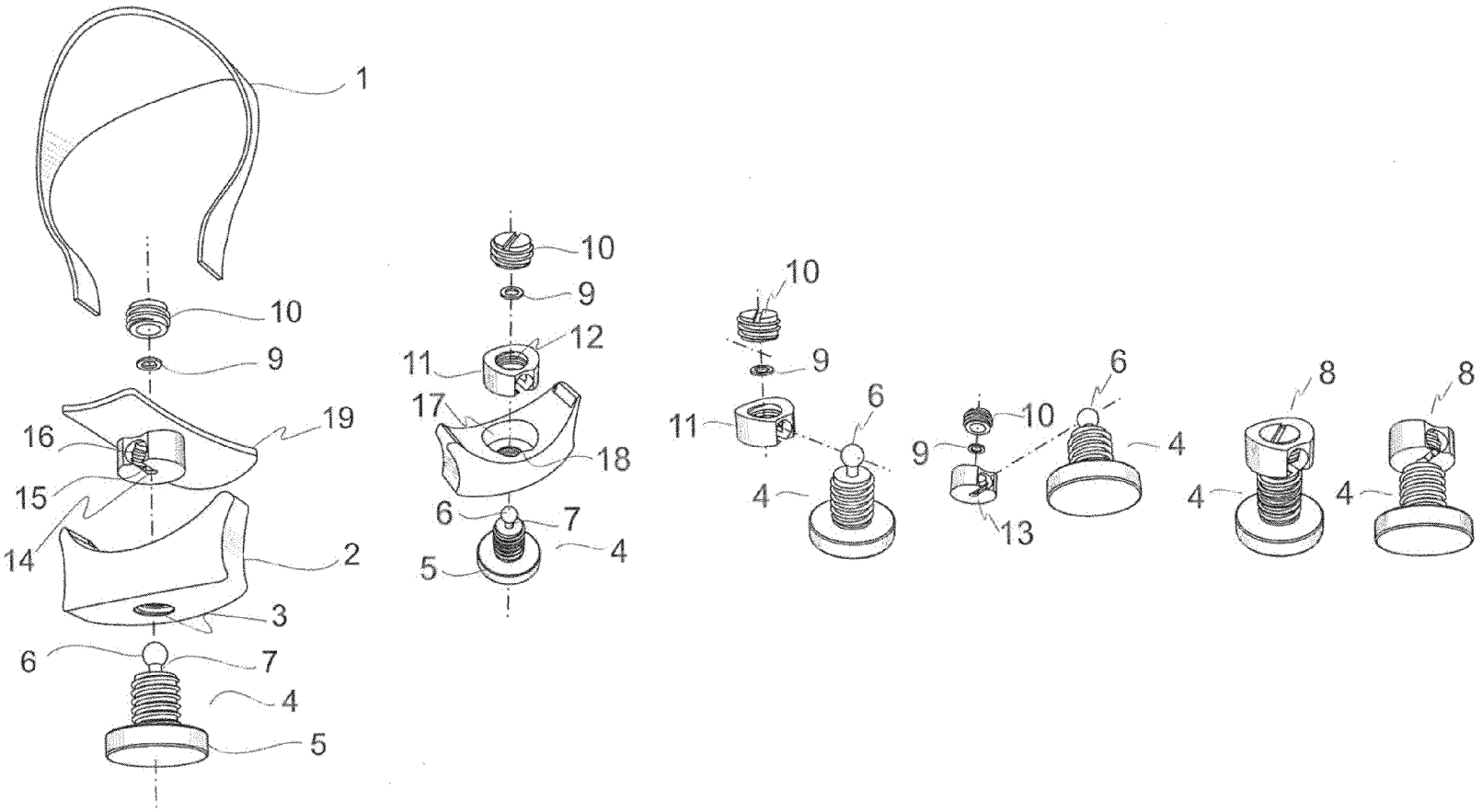
FIG. 3*e* shows schematically, and in perspective, an exploded view of the main elements of the ligature of FIG. 2*a*.
FIG. 4 shows schematically, and in perspective, an exploded view of the main elements that constitute the multidirectional pivoting means of the preferred embodiment of the present invention.
FIG. 5*a* shows schematically, and in top perspective, an exploded view of the set of the box and the fitting and clamping screw.
FIG. 5*b* shows schematically, and in bottom perspective, an exploded view of the set of the box and the fitting and clamping screw.
FIG. 5*c* is a schematic view, in top and bottom perspective, of the box and the fitting and clamping screw assembled.
Figure 6:
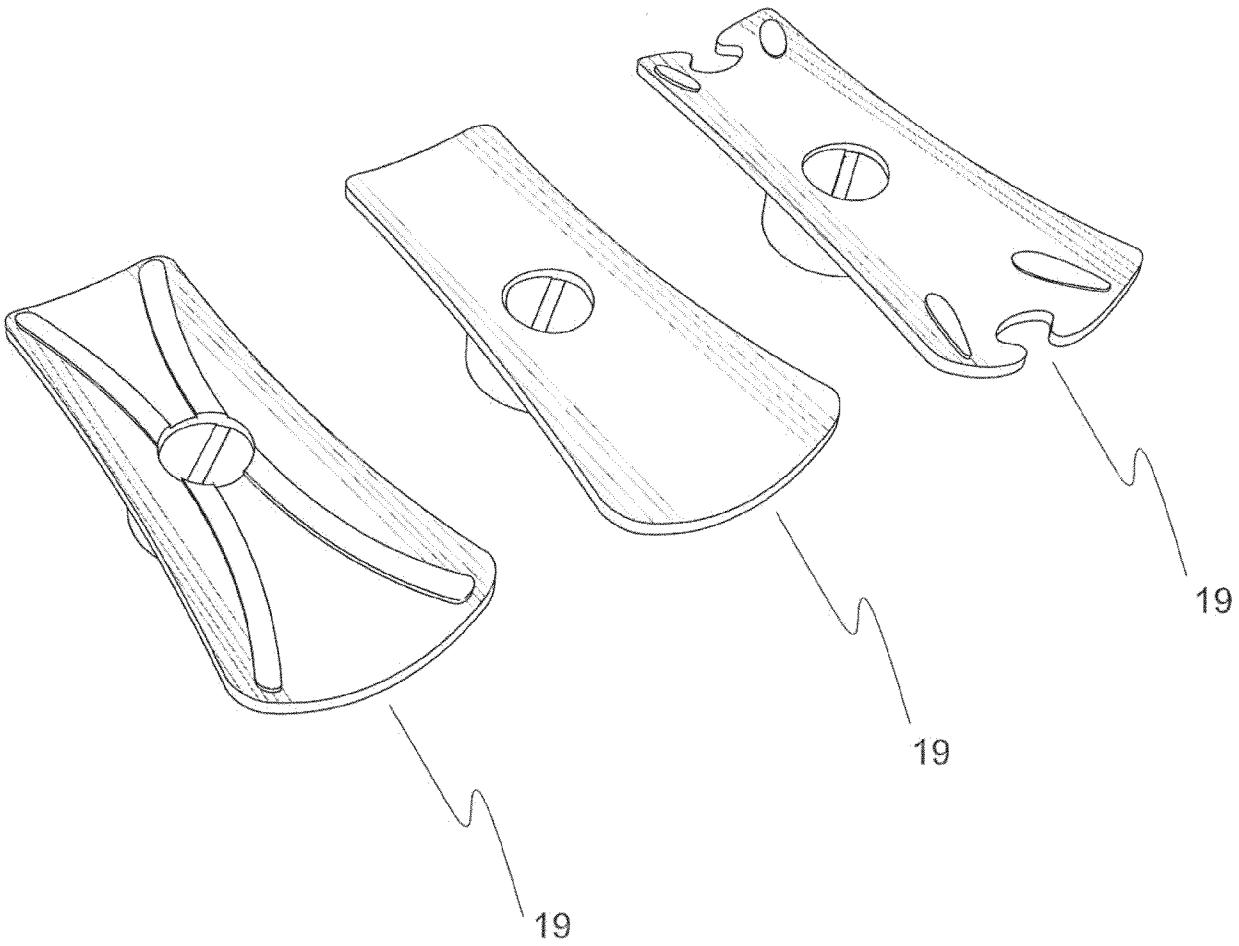
FIG. 6 is a view of preferred embodiments of sound modifier plates.
Figure 7D:
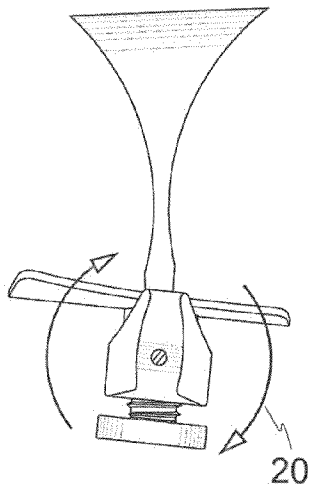
FIG. 7*d* is a schematic side view of the ligature of FIG. 7*a*, which shows the other rotational direction of the pivoting axis.
Figure 7B:
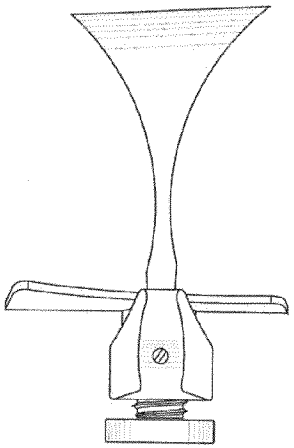
FIG. 7*b* is a schematic side view of the ligature of FIG. 7*a*.
Figure 7C:
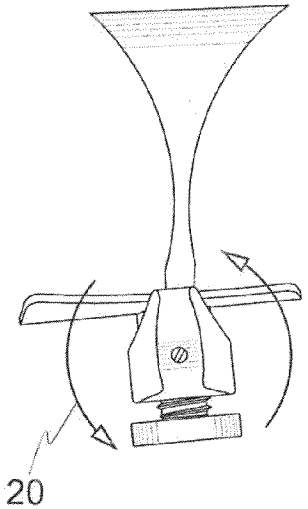
FIG. 7*a* shows schematically, and in perspective, an exploded view of the main elements of a still more preferred embodiment of the ligature of the present invention.
FIG. 7*e* is a schematic side view of the ligature of FIG. 7*a*, which shows one rotational direction of the pivoting axis.
Figure 7A:
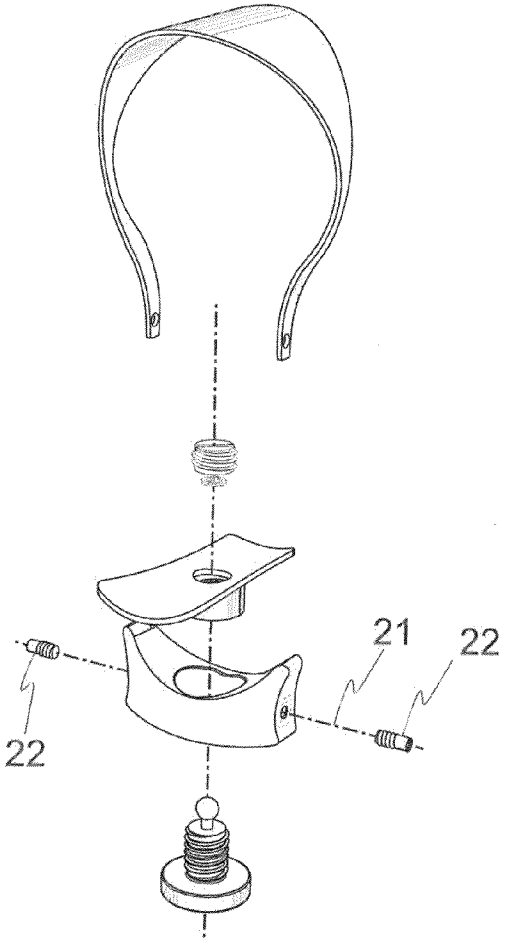
Figure 8:
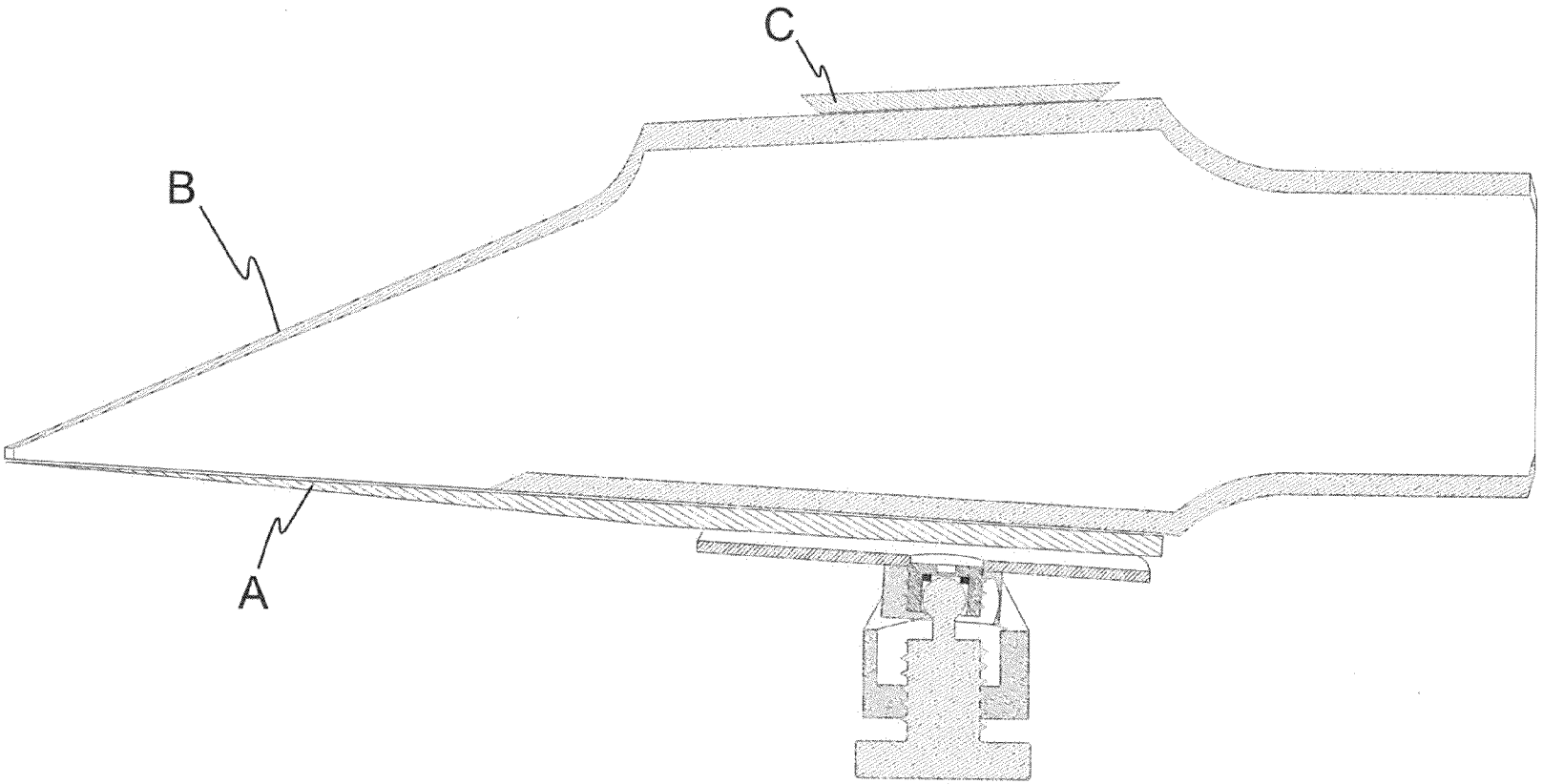
FIG. 8 shows a side cross-section of the ligature of FIG. 7*a* placed on the mouthpiece and clamping the reed.
Figure 9A:
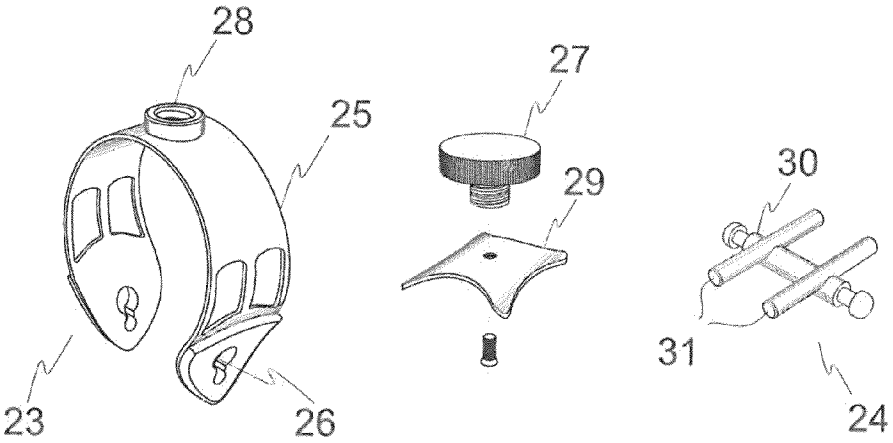
FIG. 9*a* shows schematically, and in perspective, an exploded view of the main elements of a preferred embodiment of the ligature of the present invention.
Figure 9C:
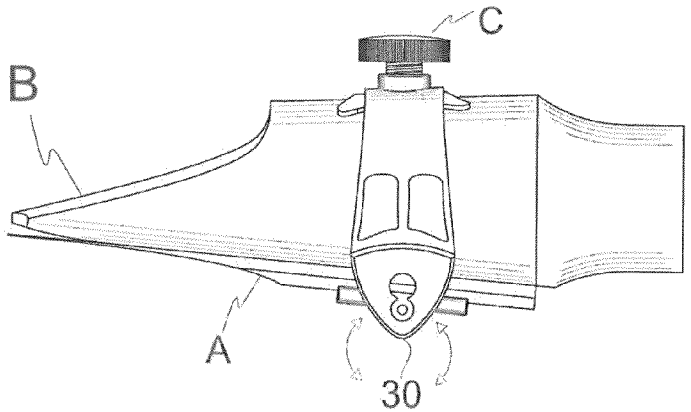
FIG. 9*c* is a schematic side view of the preferred embodiment of the ligature of the present invention.
Figure 9B:
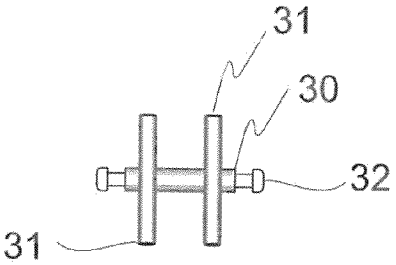
FIG. 9*b* is a bottom schematic plan view of the main element of the preferred embodiment of the ligature of the present invention.
Figure 10A:
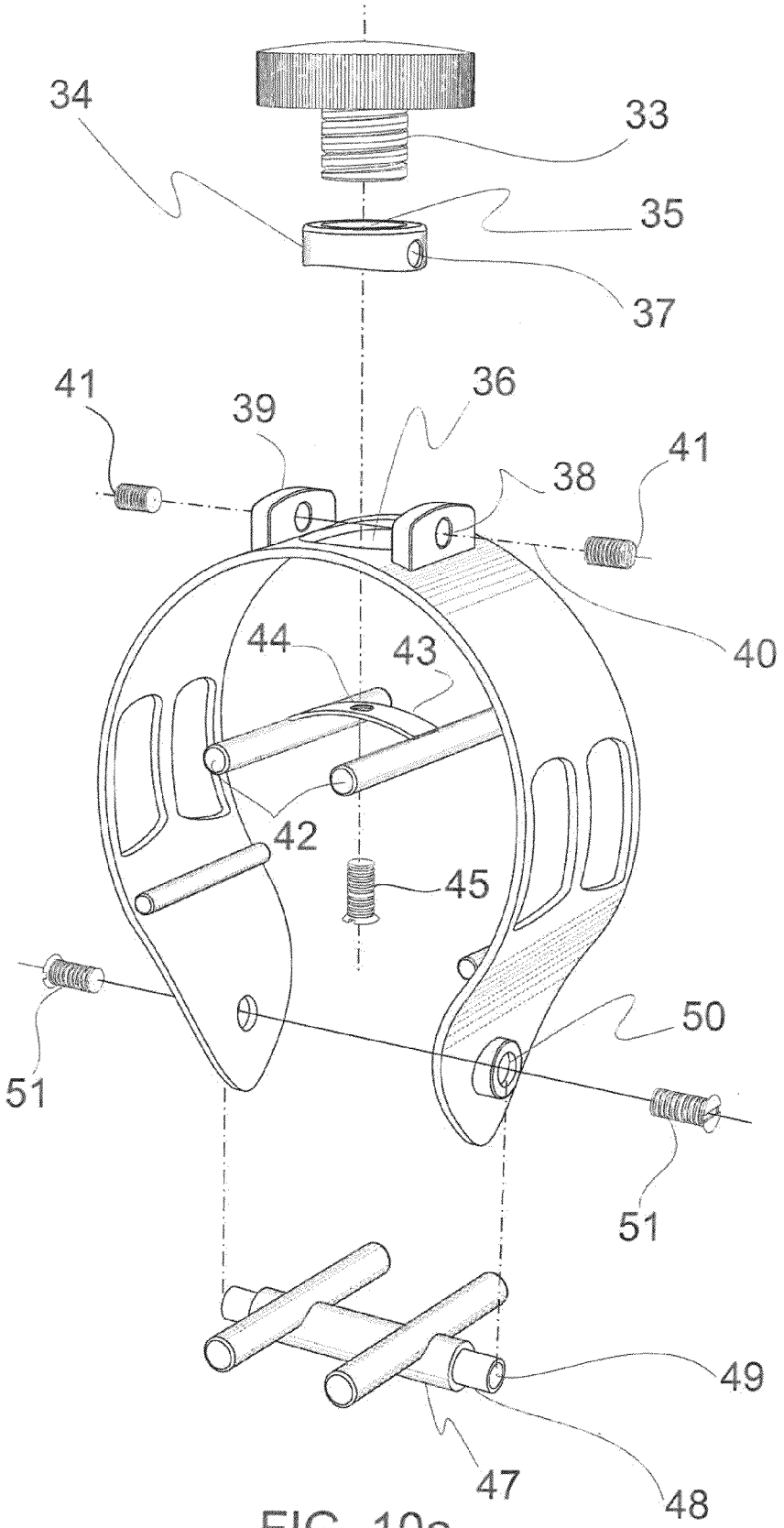
FIG. 10*a* shows schematically, and in perspective, an exploded view of the main elements of yet another still more preferred embodiment of the ligature of the present invention.
Figure 10B:
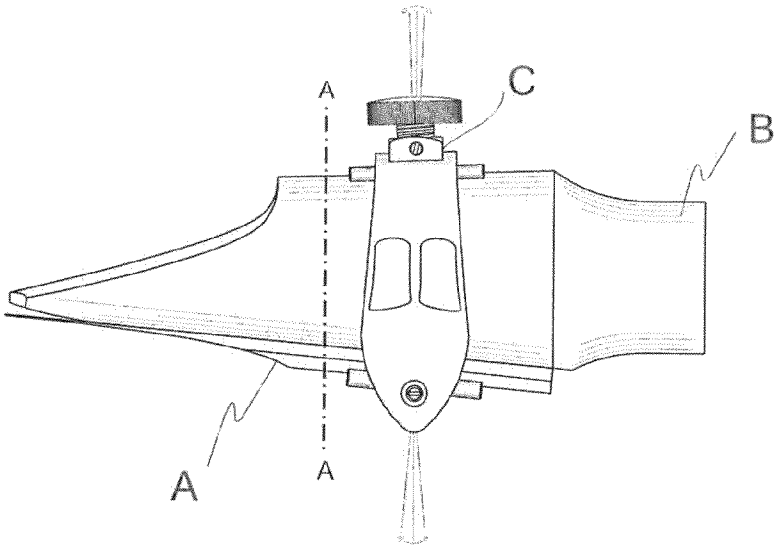
FIG. 10*b* is a side view of the ligature of FIG. 10*a* placed.
Figure 10C:
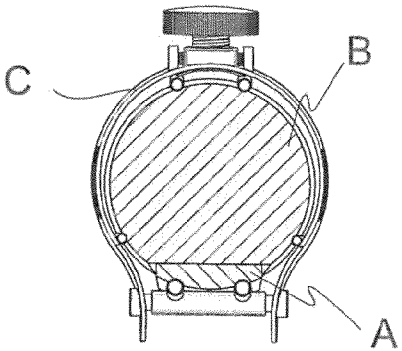
FIG. 10*c* shows a cross-section along the line AA of FIG. 10*a*.
Figure 10D:
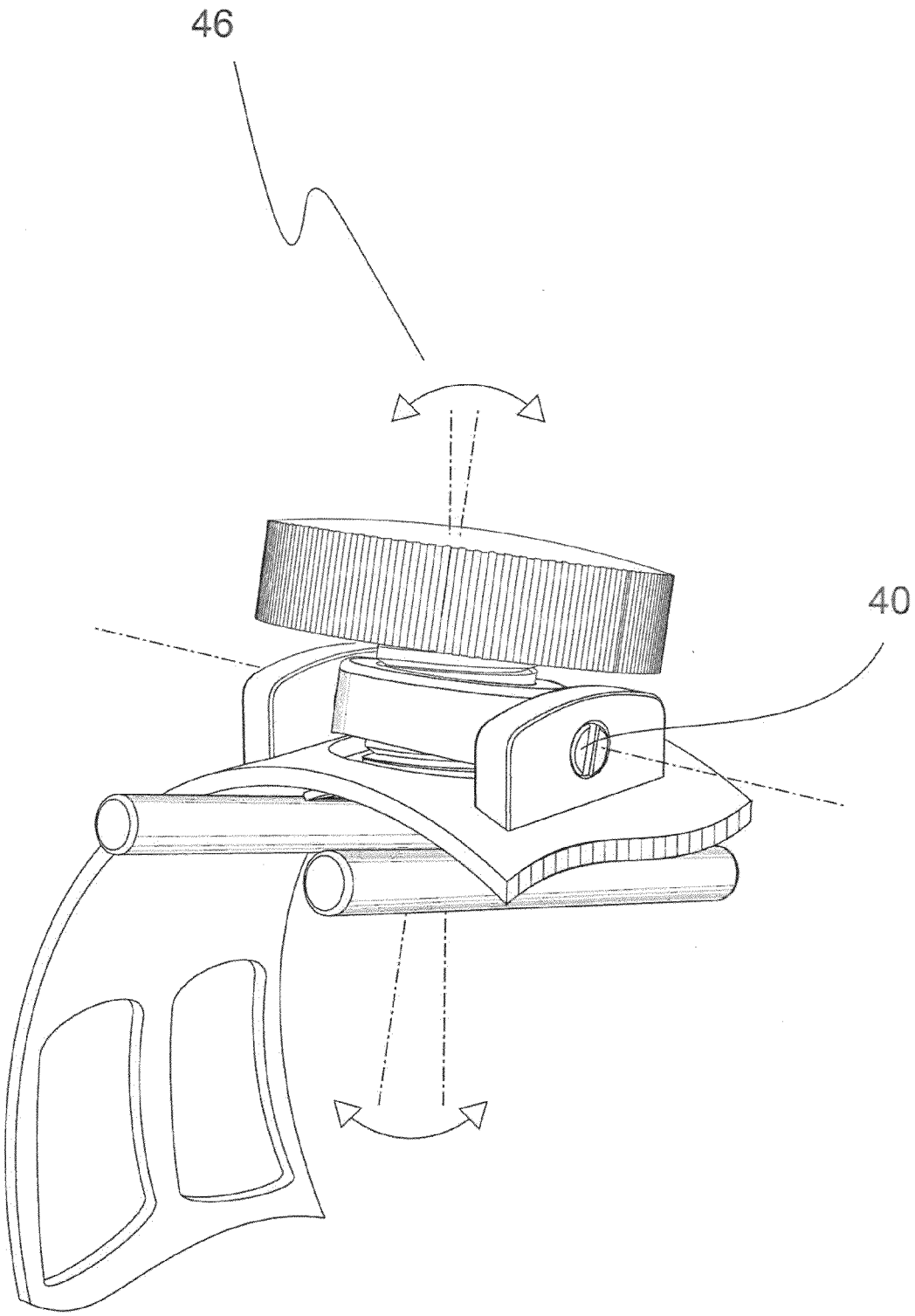
FIG. 10*d* is a perspective view with greater detail of the fitting and clamping means with pivoting system of the ligature of FIG. 10*a*.

The solution found to concurrently achieve the objectives pursued, corresponding to the present invention, is to provide a multidirectional pivoting mobile contact system. The present invention provides a solution to achieve the pursued aim, constituting a simple and ingenious conception.

In a general aspect, the invention resides in a ligature for attaching the reed to the mouthpiece of a single-reed wind instrument, basically constituted by a body, a fitting and clamping means and a multidirectional pivoting means.

In a preferred embodiment, the ligature body (C) comprises a ligature band (1) and a base (2) provided with a threaded vertical hole (3) arranged to receive the fitting and clamping means. In this embodiment the fitting and clamping means is constituted by a fitting and clamping screw (4) comprising a fitting knob (5) on one end of the threaded body and a ball-shaped ending (6) on the other end. Regarding to the shape and structure of the latter, the ball may vary its size depending on the model, being similar to the diameter of the screw threaded body. The fitting and clamping screw has two functions: one is to perform fitting and clamping of the ligature body attaching the cane to the mouthpiece table, and the other one is to support and be a functional part of the multidirectional pivoting means, being embedded to the same. The ball is attached on one side to the screw threaded body through a small cylindrical portion or "neck" (7), whose diameter is smaller than that of the ball and of the threaded body and is, further, engageable to a "box" (8), functioning as a ball-and-socket to allow mobility, thus constituting the multidirectional pivoting means. When the ball-and-socket or ball remains trapped within the box, the neck escapes to the outside through a hole, with the remainder of the screw (threaded body and adjustment knob) staying outside the box. Preferably, the box comprises:

- a very thin contact washer (9) which is located over the upper area of the ball in crown from in order to receive the fitting pressure exerted by the internal upper limit of the box, whose function is to act as ball support area and reduce frictional wear;
- a hollow screw (10) of a greater diameter than that of the ball, hollowed from an end up to about the middle of its length forming an internal cavity in order to contain the ball and the contact washer in its interior; and a body (11), formed by a preferably cylindrical external surface and an internal surface comprising a threaded hole (female thread) (12) in whose lower area presents a floor (13) providing, thus, a glass-shaped cavity arranged to receive the hollow screw. This floor has a hole (14) practiced in its center so that the neck can escape once the device is assembled and a groove (15) at the base extending from such hole to a side wall of the box body, leading to another hole (16) practiced from a side perspective over that wall, arranged to wedge and move the ball along with the neck up to the center of the box.

The box may be funned of any material that meets the requirements in terms of dimensions, hardness and ability to receive the fitting pressure exerted by the ball-and-socket on its function.

In this embodiment, the base is further provided, in its upper part, with a cavity (17) of the same shape as the box surface having a protrusion (fold) (18) in vertical direction. The threaded vertical hole extends from the bottom center to the vertical plane where the cavity begins. The purpose of this cavity with fold is acting as a rail or guide keeping the support plate in position and preventing it from rotating when performing the fitting. The dimensions of said guide do not affect the ball-and-socket operation.

In this embodiment, the sound modifier means (19) with contact points to the cane comprises a sound modifier plate which is engageable to the box.

In another embodiment, the sound modifier means is part of the box, forming a single element.

In a still more preferred embodiment, the ligature has a further pivoting means at the base of its body (20). Preferably, this pivoting means is constituted by an axis (21) transversally applied to the table in the form of two screws (22) embedded to both sides of the base piercing and clamping both ends of the ligature band. The band makes contact over the mouthpiece body and the base pivots freely. The pivot mobility margin is limited according to design and model chosen. This longitudinally pivoting system of the base is added to the ball pivot. The objective of this pivot applied to the ligature body base is to remove as much friction as possible, allowing the washer contact area over the ball to remain more centered over the screw tip, i.e. on the fitting and clamping screw axis line. Its function is applied relative to the mouthpiece body. The ligature base adapts naturally allowing a still more perpendicular fitting to the table plane.

In another embodiment, the fitting and clamping means may be arranged at the top of the ligature and, therefore, become independent from the multidirectional pivoting means.

System Assembly Through Ball Pivot

The glass can receive the ball-and-socket together with a part of the neck inside it because of the groove, the latter having dimensions prepared for this format. The screw tip (ball and neck) is inserted from the side area, moving it to the interior of the glass. Once the ball is centered in the glass, on the center hole, the hollow screw (with the washer inside) is placed from the top, and it is turned until it comes to a stop. In this way, the ball is trapped inside the hollow screw, while closing, in turn, the movement through the groove that lets it escape. The size of the central hole of the floor has a diameter suitable to allow the passage of the neck and so that it can move laterally on its axis from a fixed point belonging to the ball center, creating a pivoting means. This size may vary according to the model or design, defining the pivot mobility angle. The ball-and-socket also allows the neck to rotate on its axis in order to screw the fitting and clamping screw.

Ligature Assembly

Once the fitting and clamping screw is screwed so as to pass through the washer base, the box containing the support plate is embedded to the screw tip sliding it inside the groove. In the next step the ball is centered and the hollow screw is placed with the washer inside it, and thus the ligature and the ball-and-socket system is assembled.

In another aspect, the invention resides in a ligature (C) for attaching the reed (A) to the mouthpiece (B) of a single-reed wind instrument, basically constituted by a ligature band (23), a fitting and clamping means, a support means and a unidirectional pivoting means (24).

In one embodiment, the ligature band is a surrounding body consisting of two side surfaces (25) which have wedge holes (26) for the pivoting axis practiced at their respective ends. In this embodiment the fitting and clamping means is constituted by a fitting and clamping screw (27) and by a circular crown (28) disposed in correspondence with a hole practiced at the top and at the middle of the band to receive the referred fitting and clamping screw. The support means is constituted by a plate (29), whose shape is adapted to the mouthpiece shape to be used in order to exert uniform pressure on the upper portion of said mouthpiece. The support plate has a hole practiced on it, and the fitting and clamping screw contains a smaller screw at the thread end to hold the support plate of the mouthpiece body. The pivoting means is constituted by at least one main axis (30) transversely disposed on the reed at the mouthpiece table area and by a sound modifier means with contact points to the cane. Preferably, the sound modifier means comprises two parallel cylindrical bars (31) longitudinally arranged over the reed, wherein the contact area to the reed is only constituted by the tangent lines of the cylindrical surface of the bars with the reed bottom surface plane. The tangent lines of the bars form a parallel contact plane to the table, adaptable through the pivot movement once it makes contact with the cane. The at least one main axis is positioned in such way that the distance to the bars' ends corresponding to the cane bevel is greater than the distance to their opposite ends. The transversal main axis preferred location with relation to the parallel bars is at two thirds of its length relative to the corresponding ends to the cane bevel. Preferably, the axis is constituted by a rigid cylindrical bar which has some depression (32) practiced very close to their ends which allows the pivoting axis to interlock with wedges of the ligature band through a hinge system.

In another embodiment, the fitting and clamping means is arranged on the lower portion and is constituted by a fitting and clamping screw on the pivoting axis itself.

In another embodiment, the pivoting means is constituted by two main axes in the form of cylindrical tubes which are attached to the ligature band through an internal axis, each one of these tubes transversely containing one of the bars acting as contact point to the cane, allowing the parallel bars to move independently, once the device is assembled, and more effectively accompanying the movement produced by the vibrations on the cane.

Preferably, each cylindrical bar is arranged over each one of the longitudinal strips of intermediate thickness which are at the sides of the core of the cane.

In another embodiment, the cylindrical bars are welded to a plate.

Also in another embodiment, the sound modifier means is constituted by a sound modifier plate selected from the group comprising: longitudinal lines plates, transversal lines plates and four points plate.

In another embodiment, the pivoting axis may be constituted by a metallic cable for ligatures of the group including metallic, leather, fiber and thread meshes.

In another variant of embodiment, a pivoting support means is included. Accordingly, in one embodiment, the fitting and clamping, means is constituted by a fitting and clamping screw (33), a washer or crown (34) whose threaded hole (35) is arranged in correspondence with a hole (36) practiced at the top and at the middle of the ligature band to receive said fitting and clamping screw. The washer has two side holes (37) arranged in correspondence with respective holes (38), performed on two protrusions (39) which are laterally projected at the top of the ligature band, to receive an upper pivoting fitting axis (40), constituted by, for example, a screw pair (41). The support means comprises two longitudinal cylindrical bars (42) joined together by means of a transversal narrow plate (43) that has a hole (44) practiced centrally, arranged to receive the fitting and clamping screw which contains a smaller screw at the end of its thread (45) to hold the support means. Said support means is adapted, through the pivoting system, to the shape of the mouthpiece to be used by varying the contact angle (46) to exert uniform pressure over such mouthpiece portion.

Preferably, the ligature band has, at the height of the main axis, two holes of elongated shape towards the upper portion capable of receiving the upper pivoting fitting axis ends, acting as rails for allowing movement of said axis upward and downward, being the pivoting fitting axis supportable by a head at one end and by a nut at the other, and a screw engageable to the bottom portion of each of the holes in transversal direction with regards to the axis and in an upward direction, wherein the thread turns of the screw determine such axis location on the rail.

In another embodiment, the main pivoting axis (47) is constituted by a rigid cylindrical bar which has depressions (48) applied at the ends which have threaded holes (49) in order to be able to move the pivoting axis through some ligature band holes (50) and hold it by means of screws (51).

Other aspects of the invention contemplate the application of the multidirectional pivoting system or the pivoting axis system arranged on ligatures in the form of a closed ring.

These ligatures are used over conical mouthpieces and are fitted by pushing to the end of more volume. There are conical wood rings internally coated with rubber as a sliding surface, of other rigid materials or solely of rubber. Moreover, the implementation of the pivoting system to half-ring ligatures is also contemplated.

The clamp with multidirectional pivoting main system and, optionally, with a pivoting base of the present invention allows the reed to vibrate freely, providing all the possibilities of clamping force, either to minimal contact or with extreme fit (according to the punctual sound character selected), providing the same sound quality and uniformity in any of the clamping points along the table, within the sonorous characteristics that this implies. This is due to the fact that it adapts to the table angle of every single-reed instrument brand and model, ensuring an entirely uniform cane clamping, even adapting to the natural shape of the cane in any of its versions, either of natural or synthetic materials.

The mobile contact pivoting system not only adapts to the angle at which the cane is, but also allows the cane to couple to the table in a totally even form in its entire surface.

Bearing in mind that the sound is propagated through longitudinal waves, oscillations suffered by the cane before a vibration are accompanied by the movement that the pivot allows on the contact points, and therefore the reed is subjected to much less stress this preventing the sound from losing its structure.

The ball-and-socket main function is to allow the cane to tot vibrate in a wider range without losing clamping quality. The mobility angle and pivoting capability of this ball-and-socket system differs from ligatures with similar features in that the ball always acts freely and receives the fitting absorbing a greater range of lateral torques, allowing a pressure with a trend that better matches the perpendicular direction with respect to the table plane.

With the ball-and-socket system, the ball exerts more pressure on the contact area encompassing the crown-shaped washer and, according to the angle at which the support plate is (once it makes contact with the cane), this washer or contact area shifts resting and adapting over the ball surface corresponding to the angle more perpendicular to the cane plane, allowing its main function be more effectively applied and with less friction. As there is less friction, the fitting screw is handled in a lighter and more effective manner, since with the same principle the support area over the washer is minimal with respect to the rotation about the central screw axis.

Besides its function, the nobility angle the ball-and-socket enables in this ligature is much greater than all table angles known and therefore, the mobility generated over the plate that makes contact with the cane allows it to adapt to all the possible table angles presented in different mouthpieces according to the brand or model.

Due to the multidirectional pivoting system provided by the ball-and-socket, the sound modifier plate exerts an equitable and balanced pressure, distributed on every point making contact with the cane, and is applied in the same way on any of the types and formats already known, such as contact plate, support plate or sound modifier plate.

CONCLUSION

The contribution of this system is reflected in the artistic expression level. With the proposed ligature, the performer has more resources in terms of the number of variants of a sound.

In tins way, a better quality in execution is obtained without having to worry about the natural defects of the instrument over the musical purpose.

A ligature for musical instruments and, in particular, for simple-reed wind instruments that optimizes the relationship between fitting and sound quality, therefore, is provided. In summary, this invention is based on a new concept involving the incorporation of a multidirectional pivoting means.

Furthermore, it is clear that the present invention is not limited to the embodiments precisely illustrated and described, but also various changes and modifications can be made, especially with regard to the fitting and clamping means, element quantities, dimensions and materials used without departing from the scope or spirit of the present invention. Similarly, it should be noted that the geometric shapes of the components and elements of the ligature may be of various designs. All these alternative embodiments should be understood within the scope of protection of the set of claims which follow below.

The invention claimed is:

1. A ligature for attaching a reed to a mouthpiece in single-reed wind instruments comprising:

a ligature band including a base with a cavity;

a sound modifier with contact points to the reed;

a means passing through the ligature band for fitting and clamping the ligature, coupling the reed to the mouthpiece:

an assembly arranged at a bottom of the ligature which constitutes a multidirectional ball-and-socket pivot, to pivotably connect the sound modifier to the base, including:

a box attached to the sound modifier, positioned in the cavity of the base and having a hole; and a ball mounted to the bottom of the ligature through a neck, the ball being captured in the hole of the box.

2. A ligature according to claim 1 wherein the cavity is cavity at least partially threaded;

and the means for fitting and clamping the ligature is arranged at the bottom of the ligature and comprises a clamping screw having, at one end thereof, the ball attached to said one end by the neck, the clamping screw being threadedly engaged by the partially threaded cavity of the base.

3. A ligature according to claim 2 wherein the clamping screw comprising has a fitting knob on another end of the threaded body opposite the end to which the ball is attached.

4. A ligature for attaching a reed to a mouthpiece in single-reed wind instruments comprised of a ligature band, a means for fitting and clamping the ligature to the mouthpiece, a sound modifier having contact points to the reed, and a multidirectional pivot comprised of a ball-and-socket system including:

a ball secured by a neck to the means for fitting and clamping, the ball having a diameter; and a box comprised of a contact washer located over an upper area of the ball to receive a fitting pressure exerted by an internal upper limit of the box;

a hollow screw of a greater diameter than the diameter of the ball, hollowed from an end to approximately the middle of its length forming an internal cavity to contain the ball and the contact washer in its interior;

a body, having a base and an internal threaded hole forming a cavity with a floor to receive the hollow screw.

5. A ligature according to claim 4 wherein the floor has a hole practiced in its center enabling the neck to escape when the box is assembled, and a groove at the base extending from the hole to a side wall of the box body to another hole at the side wall of the box body to guide the ball and neck to the center of the box.

6. A ligature according to claim 2 wherein the base is provided with a projecting surface projecting into the cavity of the base, and with a threaded vertical hole extending from a bottom of the base to the cavity.

7. A ligature according to claim 1 wherein the sound modifier is a sound modifier support plate.

8. A ligature according to claim 4 wherein the sound modifier is integral with the hollow screw.

9. A ligature according to claim 1 further comprising two screws secured to opposite sides of the base and passing through opposite ends of the ligature band to secure the ligature band to the base.

10. A ligature according to claim 1 wherein the means for fitting and clamping is arranged at a top of the ligature.

* * * * *